US011848486B2

(12) United States Patent
Düde et al.

(10) Patent No.: US 11,848,486 B2
(45) Date of Patent: Dec. 19, 2023

(54) ANTENNA ARRANGEMENT FOR AN AIRCRAFT

(71) Applicants: Airbus Operations GmbH, Hamburg (DE); Airbus Operations S.A.S., Toulouse (FR)

(72) Inventors: Thomas Düde, Hamburg (DE); Christian Schaupmann, Hamburg (DE); Rubén Bancalero Santolaya, Toulouse (FR)

(73) Assignees: Airbus Operations GmbH; Airbus Operations S.A.S.

( * ) Notice: Subject to any disclaimer, the term of this patent is extended or adjusted under 35 U.S.C. 154(b) by 0 days.

(21) Appl. No.: 17/749,479

(22) Filed: May 20, 2022

(65) Prior Publication Data

US 2022/0384937 A1 Dec. 1, 2022

(30) Foreign Application Priority Data

May 31, 2021 (EP) ..... 21176977

(51) Int. Cl.
*H01Q 1/28* (2006.01)
*H01Q 1/40* (2006.01)

(52) U.S. Cl.
CPC ..... *H01Q 1/286* (2013.01); *H01Q 1/405* (2013.01)

(58) Field of Classification Search
CPC ..... H01Q 1/286; H01Q 1/405; H01Q 1/28
See application file for complete search history.

(56) References Cited

U.S. PATENT DOCUMENTS

| | | | | |
|---|---|---|---|---|
| 7,786,937 | B1 | 8/2010 | Stierhoff et al. | |
| 2014/0111390 | A1 | 4/2014 | Carides et al. | |
| 2017/0373383 | A1 | 12/2017 | Baron et al. | |
| 2019/0305408 | A1 * | 10/2019 | Chao | H01Q 1/286 |

FOREIGN PATENT DOCUMENTS

| | | | | |
|---|---|---|---|---|
| CA | 3065533 | A1 * | 12/2018 | B64C 1/1446 |
| WO | 2021046527 | A1 | 3/2021 | |

OTHER PUBLICATIONS

Extended European Search Report and European Search Opinion for European Patent Application No. 21176977.3 dated Nov. 19, 2021, 9 pgs.

* cited by examiner

*Primary Examiner* — Hoang V Nguyen
(74) *Attorney, Agent, or Firm* — Lerner David LLP

(57) ABSTRACT

An antenna arrangement for an aircraft includes an antenna unit, a radome structure covering the antenna unit, and a mounting device for mounting the antenna arrangement to an outer surface of an aircraft component. The antenna unit is mounted to or integrally formed with the radome structure and the radome structure is mounted to or integrally formed with the mounting device.

14 Claims, 3 Drawing Sheets

ANTENNA ARRANGEMENT FOR AN AIRCRAFT

FIELD OF THE INVENTION

The present invention relates to an antenna arrangement for an aircraft. Further aspects of the invention relate to an aircraft component comprising such an antenna arrangement, a mounting device for such an antenna arrangement, and an aircraft comprising such an antenna arrangement, aircraft component, and/or mounting device.

BACKGROUND OF THE INVENTION

The antenna arrangement comprises an antenna unit, a radome structure, and a mounting device. The antenna unit preferably relates to a satellite communications antenna, in particular a Ku/Ka antenna. The radome structure is preferably dome-shaped and covers the antenna unit to protect the antenna unit from weather and air loads. The mounting device is configured for mounting the antenna arrangement, i.e. the antenna unit and the radome structure, to an outer surface of an aircraft component.

Similar antenna arrangements are known in the art. Known antenna arrangements, such as the ones defined in the ARINC 791/792 standard, use a mounting device in the form of a support base, such as a plate or a frame, onto which the antenna unit is fixed to support the antenna unit against the fuselage. The support base is mounted to the fuselage and the radome structure is mounted to the support base. The support base is necessary according to ARINC 791/792 standard since the standard is optimized for large mechanically steered antenna units that required the support base to provide sufficient support against the occurring inertial loads, aerodynamic loads, and deflections loads. However, recent development in antenna technology has eliminated the mechanical steering and considerably decreased weight and size of the antenna units.

BRIEF SUMMARY OF THE INVENTION

An aspect of the invention may relate to reducing size, weight, complexity, and installation time of the antenna arrangement.

According to an embodiment, the antenna unit is mounted to or integrally formed with the radome structure and the radome structure is mounted to or integrally formed with the mounting device. The antenna unit is preferably mounted fixedly and/or directly to the radome structure and the radome structure is preferably mounted fixedly and/or directly to the mounting device. Preferably, the antenna unit is not directly mounted to the mounting device. In such a way, the mounting device is not required to carry the antenna unit and can thus have a very simple form limited to the function of attaching the radome structure to the outer surface of an aircraft component. This in turn largely reduces the size, weight and complexity of the mounting device and consequently of the entire antenna arrangement. Also, installation of the antenna arrangement on an aircraft component can be simplified and accelerated, as the antenna unit can be preinstalled within the radome structure, before mounting the radome structure to the aircraft component.

According to a preferred embodiment, the radome structure has a circumferential edge. The circumferential edge might be e.g. elliptic, circular, or have another circumferential shape. The circumferential edge is preferably directed to the aircraft component when the antenna arrangement is mounted to the aircraft component. The circumferential edge is the edge opposite from the peak of the radome structure where the inner side and the outer side of the radome structure come together.

In particular, it is preferred that the mounting device is in the form of a ring, preferably a full ring, or in the form of one or more ring segments. Such a ring shape of the mounting device can be adapted to the circumferential edge of the radome structure and relates to a very simple and lightweight shape.

It is further preferred that the mounting device is formed at the circumferential edge of the radome structure, preferably integrally formed with the circumferential edge. Such a mounting device might be for example bores for fasteners, brackets, or clamps. By such a mounting device provided directly at the radome structure, no separate mounting device is necessary so that the number of parts can be reduced.

Alternatively, it is preferred that the mounting device is formed as a separate adapter part, preferably in the form of a ring or a frame, which is mounted to the circumferential edge of the radome structure and which is configured for being mounted to the outer surface of an aircraft component. Such a mounting device formed as an adapter part allows that only the mounting device, which relates to a rather simple and inexpensive part, needs to be adapted to a specific aircraft type, while the radome structure and antenna unit can be used in a standardized manner for many different aircraft types. This largely reduces production, installation and maintenance efforts.

In particular, it is preferred that the mounting device has a profile having at least a web portion and a flange portion, e.g. a T-, L-, or C-profile. The web portion is mounted to the circumferential edge of the radome structure, preferably in an overlapping manner. The flange portion is configured for resting against and being mounted to the outer surface of an aircraft component. Such a mounting device relates to a very simple and lightweight structure that provides a reliable fixation of the radome structure to the aircraft component.

According to a preferred embodiment, the antenna unit is mounted to the radome structure, preferably fixedly and directly mounted to the radome structure, by an antenna support. The antenna support preferably includes one or more brackets fixed to both the antenna unit and the radome structure. Such an antenna support relates to a very simple and reliable means to fix the antenna unit to the radome structure.

According to another preferred embodiment, the radome structure, i.e. the space surrounded by the radome structure, is filled with a filling material covering at least parts of or preferably all of the surface of the antenna unit. The filling material might be Syntactic Foam which does not absorb any radar radiation due to it being electromagnetically inactive. By such a filling material stiffness is provided to the radome structure, the antenna unit can be protected from condensation, and RF performance of the antenna unit can be improved. Preferably, the filler material is arranged such that it would not be in contact with the outer surface of an aircraft component, when the antenna arrangement is mounted to an aircraft component. The filling material may also serve to support the antenna unit within the radome structure, so that no additional antenna support, e.g. in the form of brackets, would be necessary. However, it is also possible that both the antenna support and the filling material are employed together.

A further aspect of the invention relates to an aircraft component comprising an outer skin having an inner surface and an outer surface, wherein the outer surface is configured for contact with an ambient flow. The aircraft component further comprises an antenna arrangement according to any of the embodiments described above. The mounting device of the antenna arrangement is mounted to the outer surface of the outer skin. The features and effects described above in connection with the antenna arrangement apply vis-à-vis also to the aircraft component.

According to a preferred embodiment, the aircraft component comprises stiffeners, in particular frames and/or stringers, extending along the inner surface of the outer skin. The mounting device is mounted to the outer surface of the outer skin by fasteners, such as rivets or bolts, which are anchored within the stiffeners. In such a way, the fasteners can introduce high loads into the aircraft component without requiring additional reinforcements of the outer skin. When the mounting device has a ring or ring segment form, the mounting device usually intersects several stiffeners, so that the fasteners can be placed in regular intervals at these intersections.

In particular, it is preferred that the mounting device is mounted to the outer surface of the outer skin by the same fasteners by which the stiffeners are mounted to the inner surface of the outer skin. In such a way, the already existing fasteners and bores to attach the stiffeners to the outer skin can be used also to attach the mounting device and thus the antenna arrangement, so that no additional fasteners are required. This largely reduces costs and installation efforts and avoids additional weak points.

According to a preferred embodiment, the mounting device is adapted to the shape of the outer surface of the outer skin of the aircraft component. In such a way, the radome structure does not need to be adapted to the shape of the outer surface of the outer skin of the aircraft component, so that the radome structure can be used with different aircraft types.

According to a further preferred embodiment, the aircraft component is in the form of a fuselage or fuselage component. Preferably, the antenna arrangement is mounted to a top central part of the outer surface of the outer skin of the fuselage, and the fasteners are preferably anchored within the frames. The fuselage is a common and advantageous place for the antenna arrangement.

A further aspect of the invention relates to a mounting device for the antenna arrangement according to any of the above described embodiments, wherein the mounting device is preferably formed as a separate adapter part. The features and effects described above in connection with the antenna arrangement apply vis-à-vis also to the mounting device.

A further aspect of the invention relates to an aircraft comprising the antenna arrangement according to any of the above described embodiments, and/or comprising the aircraft component according to any of the above described embodiments, and/or comprising the mounting device according to the above described embodiments. The features and effects described above in connection with the antenna arrangement, the aircraft component, and the mounting device apply vis-à-vis also to the aircraft.

BRIEF DESCRIPTION OF THE DRAWINGS

Hereinafter, a preferred embodiment of the present invention is described in more detail by means of a drawing. The drawing shows in FIG. 1 a perspective view the rear portion of an aircraft including an antenna arrangement according to an embodiment of the invention, FIG. 2 a schematic cross sectional view of the antenna arrangement shown in FIG. 1, FIG. 3 a schematic perspective view of the mounting device of the antenna arrangement shown in FIG. 1, FIG. 4 a schematic cross sectional view of the mounting device shown in FIG. 3, and FIG. 5 a schematic top view of the mounting device shown in FIG. 3.

DETAILED DESCRIPTION

Figure 1:
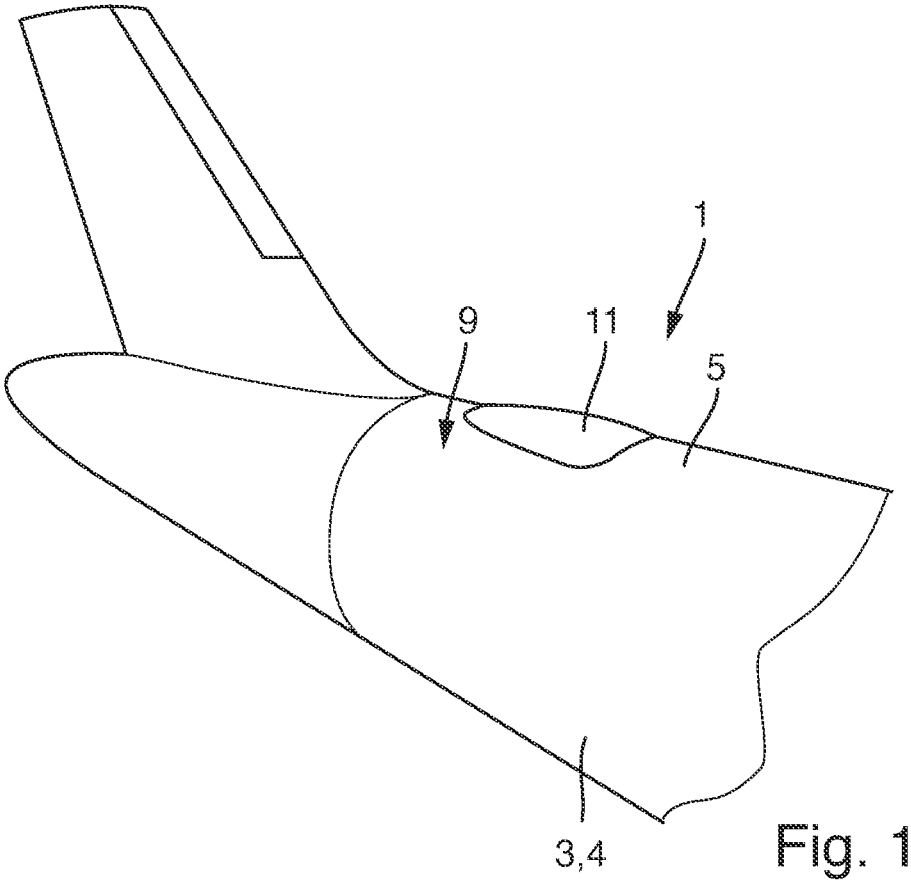

In FIG. 1 an aircraft 1 according to an embodiment of the invention is shown. The aircraft 1 comprises an aircraft component 3 in the form of a fuselage 4. The aircraft component 3 comprises an outer skin 5 having an inner surface 7 and an outer surface 9, wherein the outer surface 9 is configured for contact with an ambient flow. An antenna arrangement 11 is mounted on the outer surface 9 of the outer skin 5 in an upper rear part of the aircraft component 3, i.e. of the fuselage 4.

Figure 2:
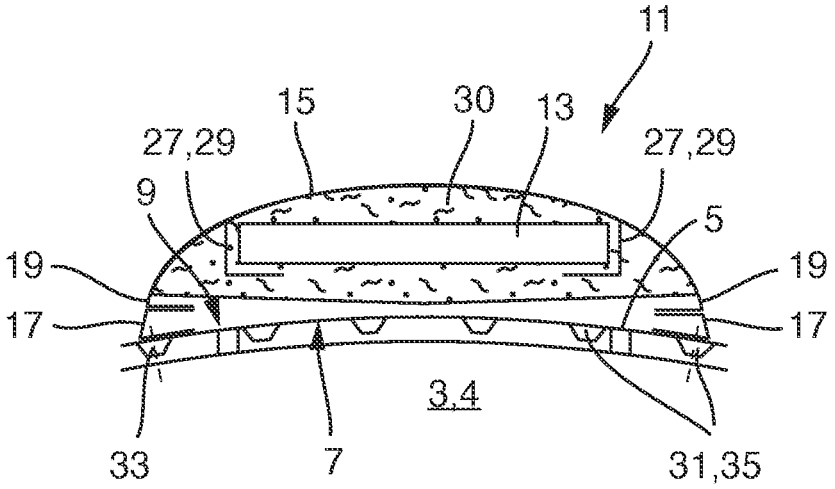

As shown in FIG. 2, the antenna arrangement 11 comprises an antenna unit 13, a radome structure 15, and a mounting device 17. The antenna unit 13 relates to a Ku/Ka satellite communications antenna. The radome structure 15 covers the antenna unit 13 to protect the antenna unit 13 from weather and air loads. The mounting device 17 mounts the antenna arrangement 11, i.e. the antenna unit 13 and the radome structure 15, to the outer surface of 9 the outer skin 5 of the aircraft component 3. The antenna unit 13 is mounted to the radome structure 15 and the radome structure 15 is mounted to the mounting device 17, while the antenna unit 13 is not directly mounted to the mounting device 17.

According to a preferred embodiment, the radome structure 15 has a circumferential edge 19 directed to the aircraft component 3 to which the antenna arrangement 11 is mounted, i.e. to the fuselage 4. The mounting device 17 is in the form of a ring adapted to the circumferential edge 19 of the radome structure 15, as shown in FIGS. 3 and 4.

Figure 3:
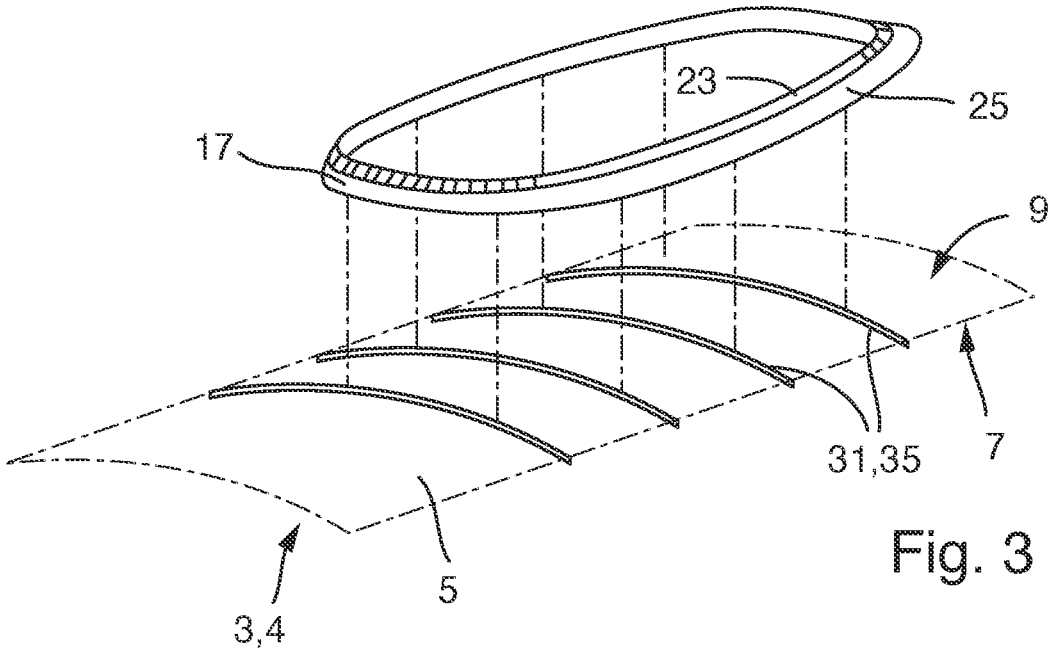
Figure 4:
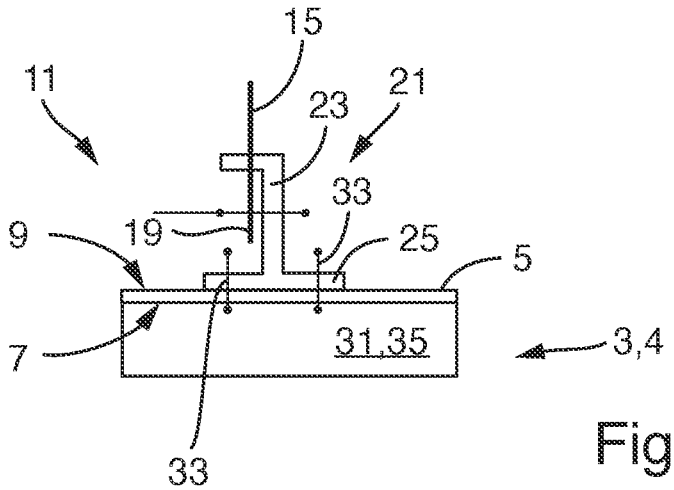

As also shown in FIGS. 3 and 4, the mounting device 17 in the present embodiment is formed as a separate adapter part which is mounted to the circumferential edge 19 of the radome structure 15 and which is mounted to the outer surface 9 of the outer skin 5 of the aircraft component 3. The mounting device 17 has a profile 21 having a web portion 23 and a flange portion 25, as illustrated in FIG. 4. The web portion 23 is mounted to the circumferential edge 19 of the radome structure 15 in an overlapping manner. The flange portion 25 rests against and is mounted to the outer surface 9 of the outer skin 5 of the aircraft component 3.

As shown in FIG. 2, the antenna unit 13 is mounted to the radome structure 15 by an antenna support 27. The antenna support 27 includes brackets 29 fixed to both the antenna unit 13 and the radome structure 15. As also shown in FIG. 2, the radome structure 15 is filled with a filling material 30, in the present embodiment Syntactic foam, covering the surface of the antenna unit 13. The filler material 30 is arranged such that it is not in contact with the outer surface 9 of the aircraft component 3.

Figure 5:
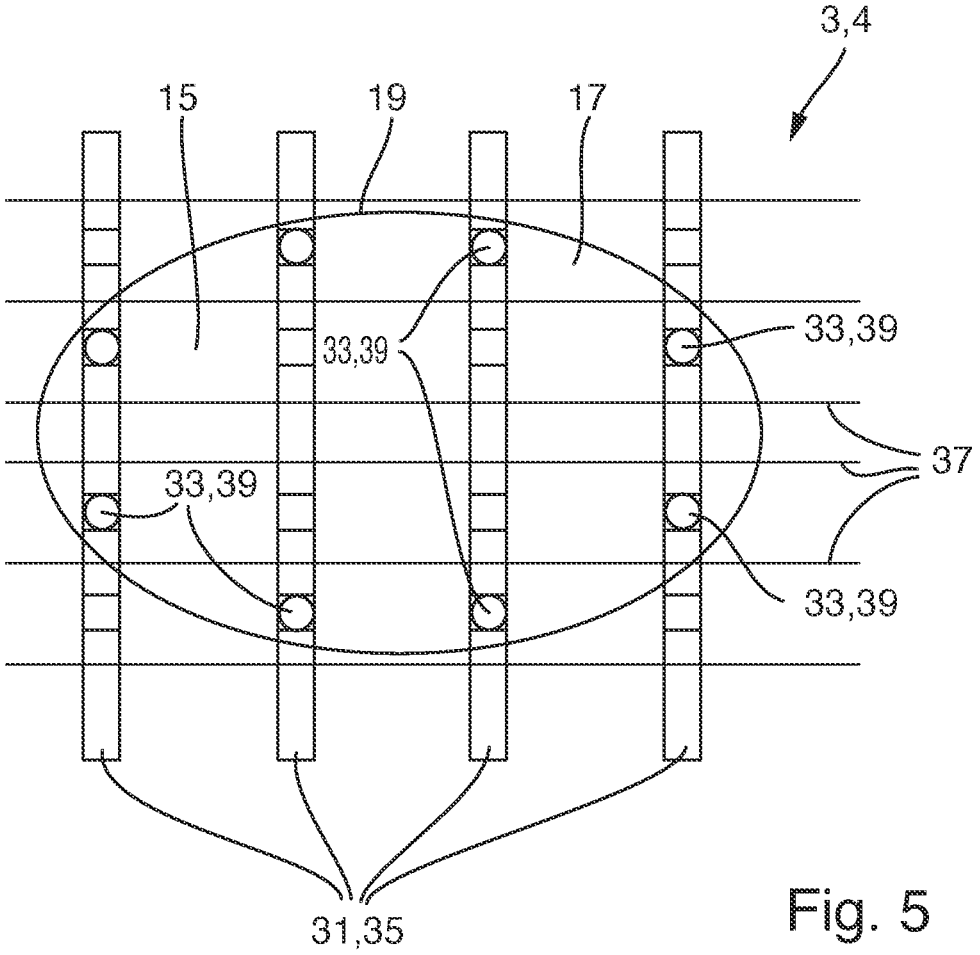

As shown in FIGS. 3 to 5, the aircraft component 3 comprises stiffeners 31, in the present embodiment frames 35 and stringers 37, extending along the inner surface 7 of the outer skin 5. The mounting device 17 is mounted to the outer surface 9 of the outer skin 5 by fasteners 33, such as rivets or bolts, which are anchored within the stiffeners 31, specifically within the frames 35. As the mounting device 17 has a ring form, the mounting device 17 intersects several stiffeners 31, so that the fasteners 33 are placed in regular intervals at these intersections 39, see FIG. 5.

As shown in FIG. 4, the mounting device 17 is mounted to the outer surface 9 of the outer skin 5 by the same fasteners 33 by which the stiffeners 31 are mounted to the inner surface 7 of the outer skin 5, so that no extra fasteners 33 are used to attach the mounting device 17 to the aircraft component 3.

As shown in FIGS. 2 and 3, the adapter-formed mounting device 17 is adapted to the shape of the outer surface 9 of the outer skin 5 of the aircraft component 3. Thus, the radome structure 15 is not adapted to the shape of the outer surface 9 of the outer skin 5 of the aircraft component 3 and can be used with different aircraft types.

By the antenna arrangement 11 as described above, the mounting device 17 is not required to carry the antenna unit 13 and can thus have a very simple form limited to the function of attaching the radome structure 15 to the outer surface 9 of the aircraft component 3. This in turn largely reduces the size, weight and complexity of the mounting device 17 and consequently of the entire antenna arrangement 11. Also, installation of the antenna arrangement 11 on an aircraft component 3 can be simplified and accelerated, as the antenna unit 13 can be preinstalled within the radome structure 15, before mounting the radome structure 15 to the aircraft component 3. Further, no extra fasteners 33 are required to attach the mounting device 17 and the radome structure 15 and antenna unit 13 can be formed as standardized parts usable with many different aircraft types.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. An antenna arrangement for an aircraft, comprising:
an antenna unit;
a radome structure covering the antenna unit; and
a mounting device for mounting the antenna arrangement to an outer surface of an aircraft component,
wherein the antenna unit is mounted to or integrally formed with the radome structure and the radome structure is mounted to or integrally formed with the mounting device.

2. The antenna arrangement according to claim 1, wherein the radome structure has a circumferential edge.

3. The antenna arrangement according to claim 2, wherein the mounting device is in the form of a ring or in the form of one or more ring segments.

4. The antenna arrangement according to claim 3, wherein the mounting device is formed at the circumferential edge of the radome structure.

5. The antenna arrangement according to claim 3, wherein the mounting device is formed as a separate adapter part mounted to the circumferential edge of the radome structure and configured to be mounted to the outer surface of an aircraft component.

6. The antenna arrangement according to claim 5, wherein the mounting device has a profile having a web portion and a flange portion,
wherein the web portion is mounted to the circumferential edge of the radome structure, and
wherein the flange portion is configured to be mounted to the outer surface of an aircraft component.

7. The antenna arrangement according to claim 1, wherein the antenna unit is mounted to the radome structure by an antenna support.

8. The antenna arrangement according to claim 1, wherein the radome structure is filled with a filling material covering at least parts of the surface of the antenna unit.

9. An aircraft component comprising:
an outer skin having an inner surface and an outer surface; and
an antenna arrangement according to claim 1,
wherein the mounting device of the antenna arrangement is mounted to the outer surface of the outer skin.

10. The aircraft component according to claim 9, wherein the aircraft component comprises stiffeners extending along the inner surface of the outer skin, and
wherein the mounting device is mounted to the outer surface of the outer skin by fasteners anchored within the stiffeners.

11. The aircraft component according to claim 10, wherein the mounting device is mounted to the outer surface of the outer skin by the same fasteners by which the stiffeners are mounted to the inner surface of the outer skin.

12. The aircraft component according to claim 9, wherein the mounting device is adapted to the shape of the outer surface of the outer skin of the aircraft component.

13. The aircraft component according to claim 9, wherein the aircraft component is in the form of a fuselage or fuselage component.

14. An aircraft comprising:
the antenna arrangement according to claim 1, and/or
the aircraft component comprising:
an outer skin having an inner surface and an outer surface;
wherein the mounting device of the antenna arrangement is mounted to the outer surface of the outer skin.

* * * * *